US008225460B2

(12) United States Patent
Hooton et al.

(10) Patent No.: US 8,225,460 B2
(45) Date of Patent: Jul. 24, 2012

(54) MULTIPLE AXIS HINGE FOR A VEHICLE BODY SIDE DOOR

(75) Inventors: Joel S. Hooton, Chesterfield, MI (US); Armand J. Ybarra, Rochester Hills, MI (US); Raymond L Wojdacki, Jr., Rochester, MI (US); Douglas J Amick, Troy, MI (US); Samer J Mona, West Bloomfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 391 days.

(21) Appl. No.: 12/536,790

(22) Filed: Aug. 6, 2009

(65) Prior Publication Data

US 2011/0030171 A1 Feb. 10, 2011

(51) Int. Cl.
*E05D 3/10* (2006.01)

(52) U.S. Cl. ..... 16/367; 16/309; 16/312; 49/226; 49/232; 49/234; 49/235; 49/260; 49/387; 296/146.12

(58) Field of Classification Search ..... 16/75, 82–85, 16/309, 311–312, 362, 364, 367, 368, DIG. 9, 16/366, 371; 49/226, 232–235, 260, 386, 387; 296/146.11, 146.12, 202
See application file for complete search history.

(56) References Cited

U.S. PATENT DOCUMENTS

| | | | | |
|---|---|---|---|---|
| 6,052,870 | A * | 4/2000 | Hagenlocher et al. | 16/347 |
| 6,808,223 | B1 * | 10/2004 | Baum et al. | 296/146.12 |
| 6,820,918 | B1 * | 11/2004 | DeBono | 296/146.11 |
| 6,845,547 | B2 * | 1/2005 | Ham | 16/374 |
| 7,100,245 | B2 * | 9/2006 | Wohlfarth | 16/367 |
| 2007/0158974 | A1 * | 7/2007 | Woodhouse et al. | 296/146.11 |
| 2007/0245525 | A1 * | 10/2007 | Hoffman | 16/367 |

* cited by examiner

*Primary Examiner* — Jack W. Lavinder
*Assistant Examiner* — Roberta Delisle

(57) ABSTRACT

A vehicle door hinge assembly includes a first hinge supported to pivot about a first axis, a guide surface, a door located at a side of the vehicle, a bracket to which the door is secured, supported to pivot about the first axis and a second axis and including a follower engaged with the guild surface, and a strut secured to the bracket that extends as the bracket pivots toward an open position and retracts as the bracket pivots toward a closed position.

15 Claims, 4 Drawing Sheets

MULTIPLE AXIS HINGE FOR A VEHICLE BODY SIDE DOOR

BACKGROUND OF INVENTION

The present invention relates generally to a motor vehicle door hinge assembly having multiple hinge axes about which the door pivots.

A vehicle door that opens along two separate swing paths opens outward along a substantially vertical axis and then upward along an axis that is substantially parallel to the longitudinal axis of the vehicle. When the door is fully open, however, the door can fall back into the A-pillar, to which the hinges are secured, and the door may swing upward before there is sufficient clearance with respect to the front fender.

A need exists in the industry for a door hinge assembly that provides multiple axes about which the door pivots as it opens and closes. Movement of the door as it opens and closes should be guided on a continuous guide path, whose contour can be varied readily to produce angular configurations that avoid interference with road curbing and other obstacles. The hinge assembly preferably would locate the door cutline such that it is visually imperceptible due to its location below the vehicle.

SUMMARY OF INVENTION

A vehicle door hinge assembly includes a first hinge supported to pivot about a first axis, a guide surface, a door located at a side of the vehicle, a bracket to which the door is secured, supported to pivot about the first axis and a second axis and including a follower engaged with the guide surface, and a strut secured to the bracket and that extends as the bracket pivots toward an open position and retracts as the bracket pivots toward a closed position.

The invention contemplates a method for supporting a vehicle door that includes the steps of providing a first hinge that pivots about a first axis, securing the door to a bracket that is supported on the first hinge to pivot about a second axis, guiding movement of the bracket on a guide surface that is secured in position, and supporting the door in an open position by securing an expandable and retractable strut to the bracket and to a body of the vehicle.

The hinge assembly provides a strut that can be actuated using an onboard power source enabling the doors to be operated other than manually. Swing angles allow the door to close very similar to a conventional door system.

The door is guided as it opens and closes on a continuous, repeatable guide path, whose contour can be varied readily to produce new, unique angular configurations that avoid interference with road curbing.

The hinge assembly allows the cutline to be visually imperceptible due to its location below the vehicle. The design reduces the width of the occupant step out.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DETAILED DESCRIPTION

Figure 1:
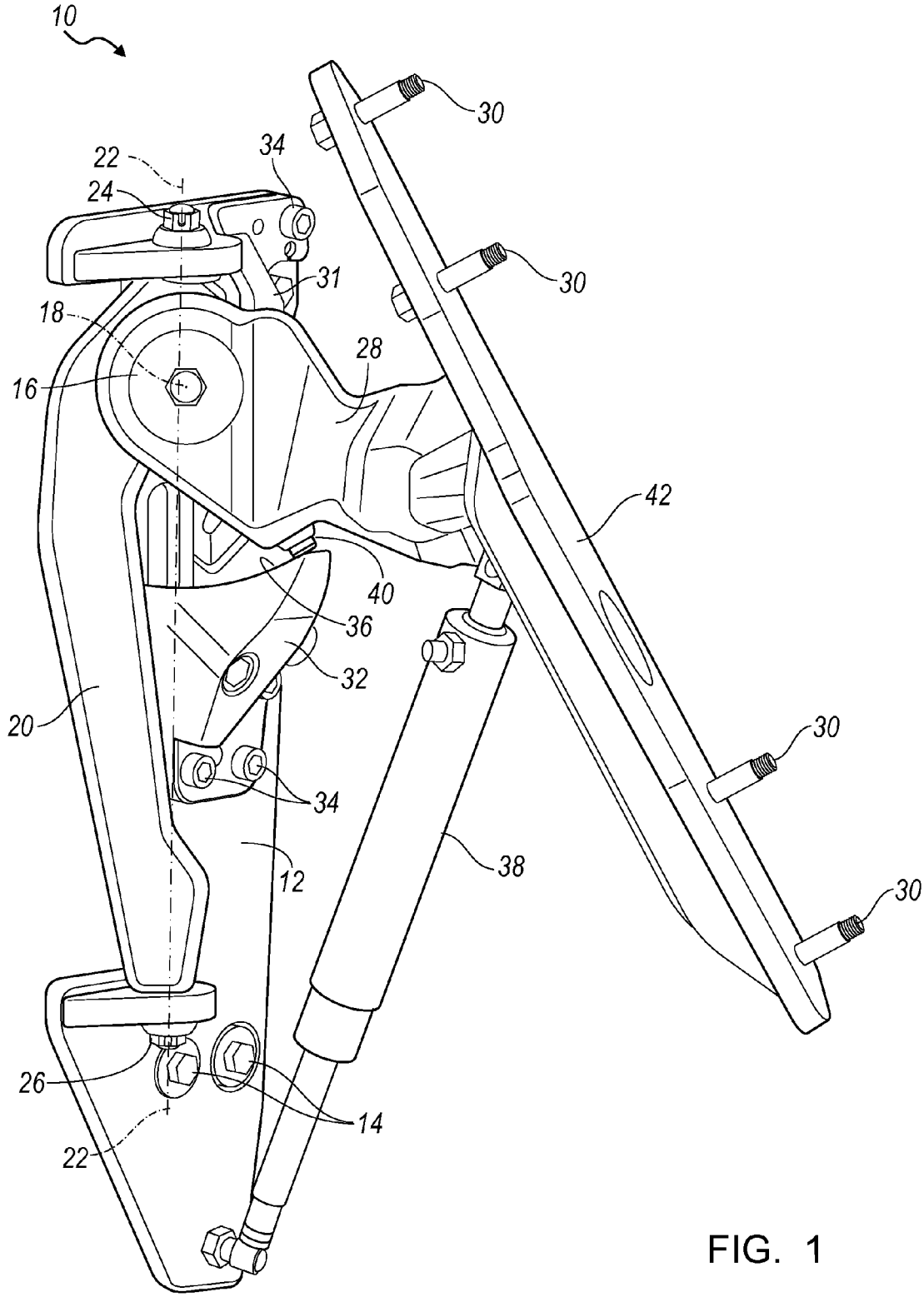
FIG. 1 is a perspective side view of a multiple door hinge assembly that supports the driver side body side door, the hinge being in its fully open position.

Referring now to the drawings, there is illustrated in FIG. 1 a multi-axis hinge assembly 10 that supports the side body door of a motor vehicle as it opens and closes and becomes sealed and latched on the hinge pillar of the vehicle's body.

The assembly 10 includes a body-side bracket 12, which is secured by bolts 14 to the hinge pillar; a vertical hinge 16, which allows the door to swing about an axis 18; a horizontal hinge 20, which is supported to pivot about an axis 22 at upper and lower hinge pins 24, 26, allowing the door to swing about axis 18; a door bracket 28, attached by bolts 30 to the forward edge of the door and supported at the vertical hinge 16; upper and lower guide block 31, 32, secured by bolts 34 to bracket 12, the lower block 32 being formed with a guide surface 36, which guides the path of the door swing; and a strut 38, secured at one end to bracket 12 and at the opposite end to bracket 24, for holding the door open and stabilizing bracket 24 as it pivots about axis 18 while the door opens and closes. The first and second axes 18, 22 are mutually perpendicular, axis 22 being substantially vertical and axis 18 being substantially horizontal.

Door bracket 28 includes a follower 40, which is continually engaged with the arcuate, sloped surface 36. The door swings about axes 18 and 22 as door bracket 28 slides along surface 36 from its lowermost, lowest sloped portion, when the door is closed, toward its uppermost, highest sloped portion, when the door is open, as shown in FIG. 1. As the slope of surface 36 increases, the door swings higher. The upper guide block 31 maintains the follower 40 of door bracket 28 in contact with guide surface 36.

Figure 2:
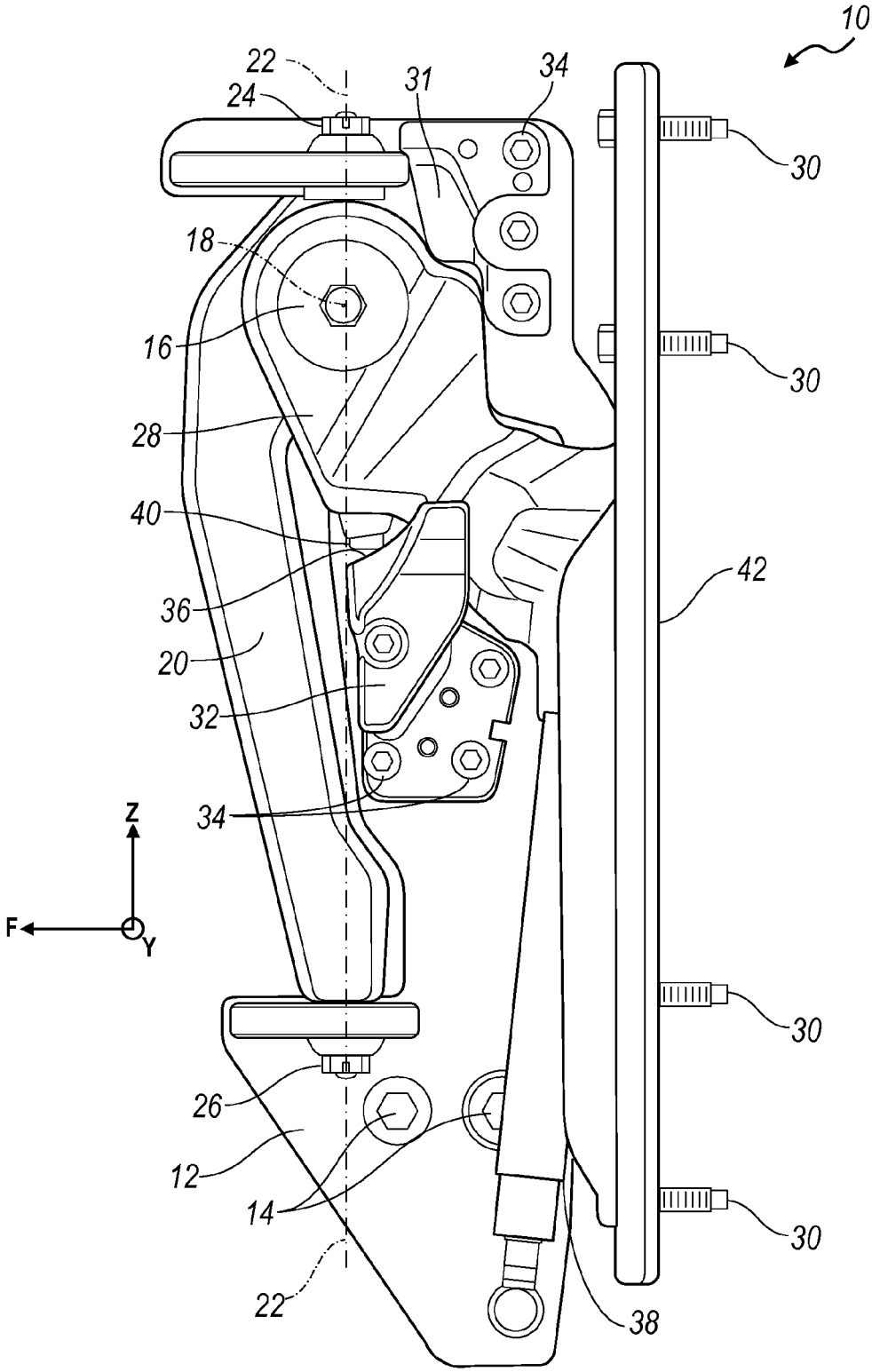
FIG. 2 is side view looking inboard at the door hinge assembly of FIG. 1, which is in the closed position.

FIG. 2 is a side view showing the door hinge assembly 10 in its closed position with the strut 38 retraced, i.e., its piston inserted into its cylinder, follower 40 at the lower end of guide surface 36, and the rear surface 42 of door bracket 28 substantially vertical and facing rearward.

Figure 3:
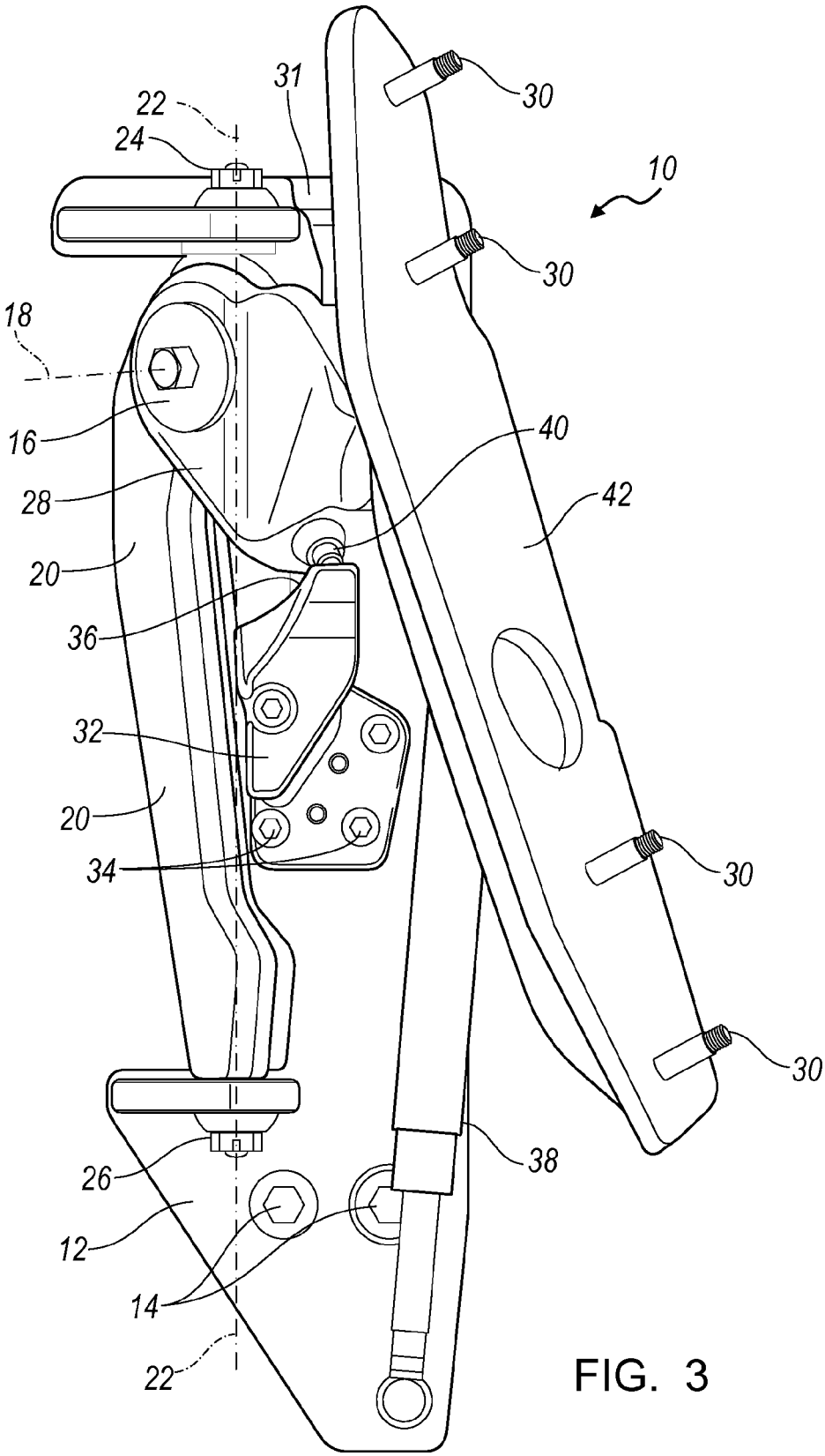
FIG. 3 is side view looking inboard at the door hinge assembly of FIG. 1, which is nearing its open position.

FIG. 3 is a side view showing the door hinge assembly 10 nearly fully open showing the horizontal hinge 20 having rotated clockwise about axis 22, follower 40 having moved toward the upper end of guide surface 36, the rear surface 42 of door bracket 28 facing upward, due to having rotated about axis 22, and upward due to having rotated about axis 18, and strut 38 more fully extended.

Figure 4:
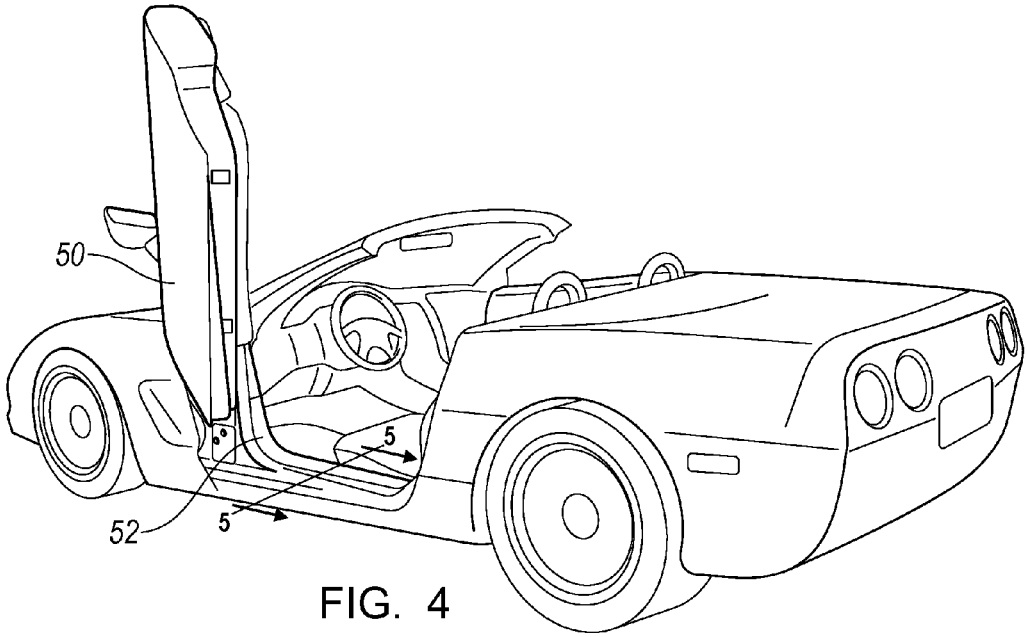
FIG. 4 is a side perspective view showing the driver side door open and supported by the multiple axis hinge assembly.

FIG. 4 shows a vehicle door 50 fully open and supported on the vehicle's hinge pillar 52, to which the body side bracket 12 is secured by bolts 14.

Figure 5:
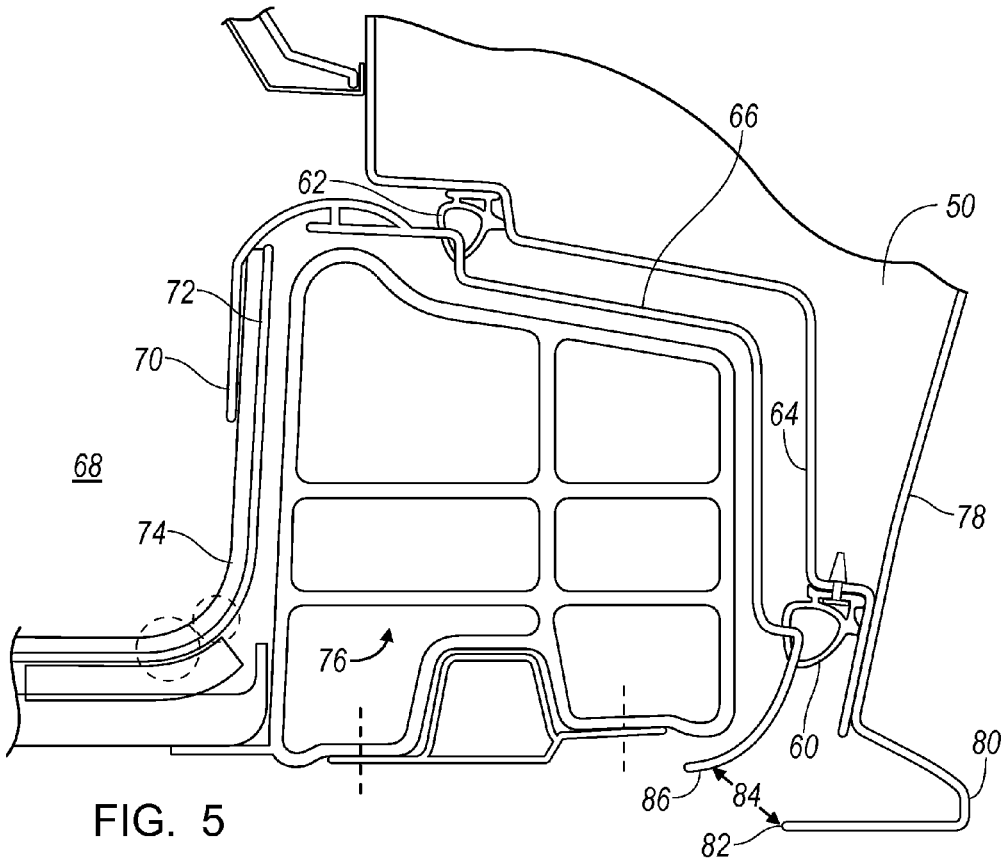
FIG. 5 is a cross sectional view taken at plane 5-5 of FIG. 4.

FIG. 5 illustrates the door 50 in its closed position with compression seals 60, 62, attached to an inner door panel 64 and contacting the outer surface of the rocker panel 66, thereby protecting the interior 68 of the vehicle against entry of water, dirt and other contaminants. A tab 70 secured to the upper, inner edge of rocker panel 66 overlaps and secures the upper edge 72 of a floor covering 74 in its proper position. The rocker panel 66 surrounds a structural reinforcement 76, which extends longitudinally across the door opening.

Conventionally, a gap is provided between the lower edge of the door and an upper edge formed on the rocker panel, thereby causing a visible discontinuity in the contour of the outer surface comprising the lower outer surface of the door and the outer surface of the rocker panel immediately below the door opening. This gap is called a "cutline."

FIG. 5 shows that when door 50 is closed, no discontinuity in the contour of the outer surface 78 near the lower edge of the door is visible. Instead, the outer surface 78 is continuous and uninterrupted to and around a bump out 80 formed at the lower edge 82 of the door. When the door 50 is closed, the cutline 84, located between the lower edge 82 of the door 50 and the surface 86 of the rocker panel 66, is located inboard of the bump out 80 and faces downward and inboard, away from the outer surface 78. The cutline 84 that results using the door 50 is hidden and imperceptible to view in any direction other than from below the vehicle.

While certain embodiments of the present invention have been described in detail, those familiar with the art to which this invention relates will recognize various alternative designs and embodiments for practicing the invention as defined by the following claims.

What is claimed is:

1. A hinge assembly for a door of a vehicle comprising:

a first bracket able to be fixed in position on the vehicle;

a first hinge supported to pivot on the first bracket about a first axis;

a second bracket supported on the first hinge, to pivot about a second axis and including a follower engaged with a guide surface formed on a block secured to the first bracket, said guide surface having a variable slope that increases as a distance between the follower and the first bracket increases as the second bracket moves toward an open position; and a displaceable strut secured to the first and second brackets throughout a range of motion between open and closed positions for holding the second bracket in an the open position.

2. The hinge assembly of claim 1, wherein the strut is secured to the second bracket at a location eccentric of the second axis such that the strut extends and retracts as the door opens and closes.

3. The hinge assembly of claim 1, wherein the first axis is substantially vertical and the second axis is substantially horizontal.

4. The hinge assembly of claim 1, wherein the first and second axes are mutually perpendicular.

5. The hinge assembly of claim 1, wherein the second bracket includes a surface onto which the door is secured to the second bracket.

6. The hinge assembly of claim 1, wherein engagement of the follower with the guide surface is maintained throughout a range of motion between the open and closed positions.

7. A hinge assembly for a vehicle, comprising:

a first hinge supported to pivot about a first axis;

a bracket supported to pivot about the first axis and a second axis and including a follower engaged with a guide surface over a range of motion between open and closed positions;

a body side bracket able to be fixed in position on the vehicle, including a block formed with the guide surface, the guide surface having a variable slope that increases as a distance between the follower and the body side bracket increases as the hinge assembly moves toward the open position; and a strut secured to the bracket and the vehicle over a range of motion between the open and closed positions.

8. The hinge assembly of claim 7, wherein the strut is secured to the bracket at a location eccentric of the second axis.

9. The hinge assembly of claim 7, further comprising a body side bracket able to be fixed in position on the vehicle and to which the first hinge is secured to pivot about the first axis.

10. The hinge assembly of claim 7, wherein the first axis is substantially vertical and the second axis is substantially horizontal.

11. The hinge assembly of claim 7, wherein the first and second axes are mutually perpendicular.

12. The hinge assembly of claim 7, further comprising a block secured to a body side bracket and contacting the bracket, said contact maintaining the follower engaged with the guide surface as the door opens and closes over a range of motion between the open and closed positions.

13. A hinge assembly for a door of a vehicle comprising:

a first bracket able to be fixed in position on the vehicle;

a first hinge supported to pivot on the first bracket about a first axis;

a second bracket supported on the first hinge to pivot about a second axis;

a follower attached to the second bracket and with a guide surface for guiding movement of the door relative to the first bracket throughout a range of motion of the door between open and closed positions;

a guide surface formed on a block that is secured to the first bracket, the guide surface having a variable slope that increases as a distance between the follower and the first bracket increases as the second bracket moves toward the open position; and a strut secured to the first and second brackets throughout a range of motion of the door between the open and closed positions.

14. The hinge assembly of claim 13, wherein the guide surface is secured to the first bracket.

15. The hinge assembly of claim 13, wherein the follower is secured to the second bracket.

* * * * *